US006148144A

United States Patent [19]

Milanese

[11] Patent Number: 6,148,144

[45] Date of Patent: Nov. 14, 2000

[54] PORTABLE LINEAR SHAPED STEAM CLEANER

[75] Inventor: Andrea Milanese, Susegana, Italy

[73] Assignee: Euroflex srl, Susegana, Italy

[21] Appl. No.: 09/239,492

[22] Filed: Jan. 29, 1999

[51] Int. Cl.[7] ..... A61H 33/12; A47L 7/00

[52] U.S. Cl. ..... 392/405; 15/320

[58] Field of Search ..... 392/394, 396, 392/397, 398, 400, 401, 402, 403, 404, 405, 406, 497, 498; 15/320, 321, 322

[56] References Cited

U.S. PATENT DOCUMENTS

| | | | |
|---|---|---|---|
| 2,726,314 | 12/1955 | Prain | 392/498 |
| 3,660,635 | 5/1972 | Liebert | 392/377 |
| 3,868,494 | 2/1975 | Pepin | 392/377 |
| 3,908,602 | 9/1975 | Brulfert et al. | 122/4 D |
| 4,682,010 | 7/1987 | Drapeau et al. | 392/488 |
| 5,252,134 | 10/1993 | Stauffer | 392/403 |
| 5,305,415 | 4/1994 | Stevens | 392/403 |
| 5,447,597 | 9/1995 | Zimmermann et al. | 392/404 |
| 5,502,872 | 4/1996 | Chae et al. | 15/320 |
| 5,881,207 | 3/1999 | DeBourg et al. | 392/401 |
| 5,920,952 | 7/1999 | Baldacci | 15/320 |

*Primary Examiner*—Sang Paik
*Attorney, Agent, or Firm*—Dowell & Dowell, P.C.

[57] ABSTRACT

A compact and portable unit for generating and releasing of steam in a steam cleaner wherein the cleaner is linear and tubularly shaped having an upper end functioning as a handle. The unit includes an internal boiler including a resistance heater which is operatively controlled to prevent overheating depending upon lack of water within the unit and the displacement of water from the heater during the use of the cleaner. The cleaner may be utilized with conventional cleaning attachments or accessories.

9 Claims, 4 Drawing Sheets

PORTABLE LINEAR SHAPED STEAM CLEANER

BACKGROUND OF THE INVENTION

Field of the Invention and Related Art

This invention relates to the field of steam cleaning and washing machines. Known are steam cleaning machines, constituted by a boiler with an electric heater provided with a flexible hose and a rigid tube at the end of which is attached a multifunctional brush (with bristles, without bristles, rag-holder). The boiler is mounted on wheels so that it can trail the cleaning brush.

Such cleaning machines are very cumbersome because the rigid tube, the flexible hose and the wheel-mounted boiler frequently create hindrances to the user, entailing many encumbrances and rigidity of movement of the brush.

Furthermore, given the configuration and the capacity of the boiler, some time elapses before the water vaporizes and reaches the operational pressure.

There are steam cleaners specifically for floors, in which the boiler and the brush or the nozzle are enclosed in a single housing which is provided with wheels and a handle. These cleaners must be rolled on the floor to clean. Such type of cleaners are very heavy and inconvenient to drag along on different floors, especially on steps.

SUMMARY OF THE INVENTION

The main object of the present invention is a novel, light-weight and manageable, compact unit for the generating and releasing of steam.

The novel steam-generating unit has a linear shape, is generically tube-shaped, and its upper end is shaped as a handle. Such a unit, provided with a housing, comprises a boiler, a thermoelectric resistance, a steam tube, a quick-action or quick disconnect coupling, an electrovalve for the release of the steam, two thermostats, a water level sensor, and a manometer.

DESCRIPTION OF THE PREFERRED EMBODIMENTS

Figure 3B:
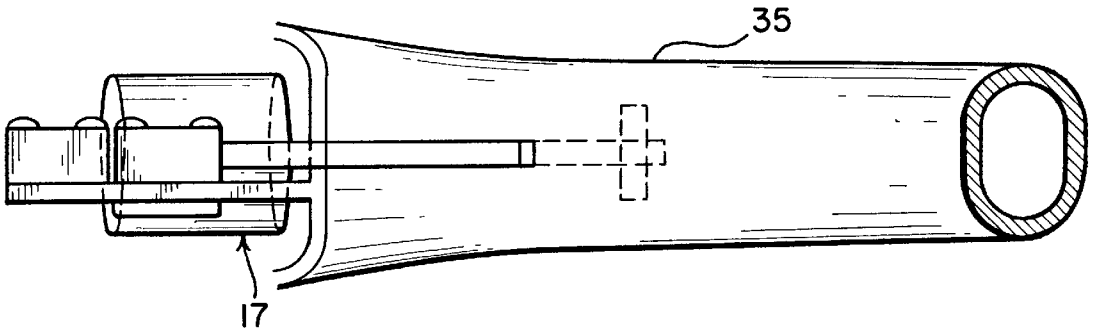
Figure 3A:
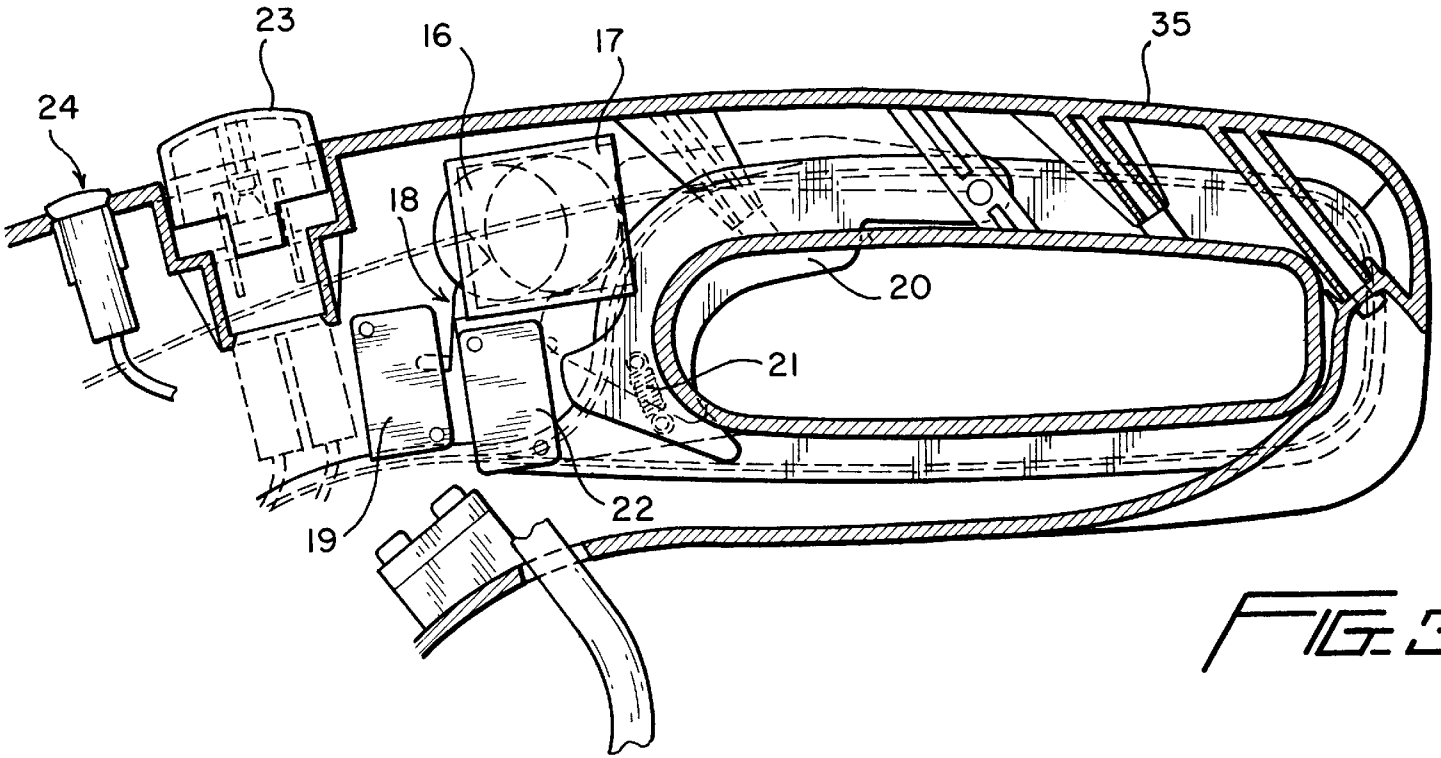

FIG. 3*a* is an enlarged partial cross sectional view of the control handle of the invention.

FIG. 3*b* is a partial cross sectional view of the control handle of FIG. 3*a* taken along line 3*b*—3*b*.

Figure 4:
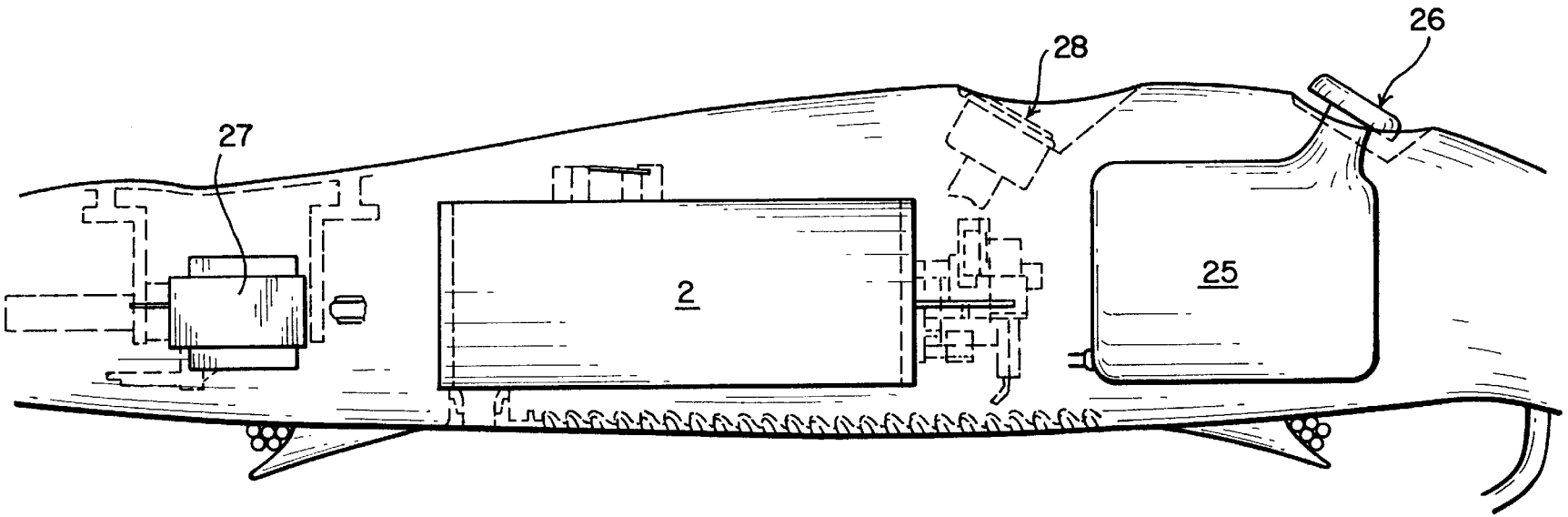

FIG. 4 is a partial side elevational view of a variation of the invention having portions broken away.

The a steam cleaner "A" includes a housing 1 in which is mounted "a" boiler 2 constituted by a relatively narrow and high cylindrical tank, preferably made out of steel or a metal alloy.

On the bottom portion of a tank is provided the thermoelectric resistance element 3 for the heating of the water.

On the upper portion of a boiler is attached the steam-outlet tube 10 from the boiler. This tube runs along the side of the boiler and connects to the quick-action or disconnect coupling 30 at bottom of housing.

On the upper portion of the boiler is provided a plug 6 for the filling of water through tube 5.

An electrovalve 8 for the steam flow has an inlet 7 inserted into boiler and communicates with the steam-outlet tube.

The electrovalve is generally closed and opens electrically by means of a pulsating control or microswitch 22 that is preferably provided on a handle 35 so that, at the desired moment, it releases the pressurized steam, already generated and contained in the boiler.

A manometer 9 and the pressurestat 4 are also provided on the upper portion of the boiler tank; the manometer indicates the internal pressure of the boiler tank while the pressurestat indicates the depletion of water.

Two thermostats, one 11 for operation and the other 12 for safety, are installed at the tank at an appropriate position.

One of these thermostats, fixed or adjustable, controls the operation of the thermoelectric resistance for the constant steam generation.

The other thermostat controls the entire electric circuit and is actuated in the case of an overheating of the boiler. This second thermostat can also be substituted with a thermal fuse.

The water pressure, and consequently its generating, is also controlled by the pressurestat having a predetermined setting. The pressurestat actuates the pertinent warning light when the water is exhausted.

On the handle is provided a safety device that opens the electric power circuit of the resistance heater in the boiler when water level in the unit is lowered beyond a determinate level.

As a matter of fact, it is necessary that the electric resistance heater be always surrounded by water. If the unit is inadvertently placed horizontally or if the water, contained inside the boiler tank, is spilled, an ensuing overheating may result by leaving the resistance heater uncovered.

The unit also comprises a safety device consisting of a ball 16 inserted in a guide cylinder 17 that, in its regular position, actuates either directly or through a lever 18 upon a microswitch 19 for the power supply to the resistance heater in the boiler while, if the unit is lowered, this ball moves inside the cylinder releasing the lever and opening the microswitch.

On the handle is also provided a trigger lever 20 with a pull-back spring 21 that actuates on the microswitch in order to open the electrovalve 18 for the release of steam.

Also provided is a main switch 23 and a warning light signal 24 connected to the safety circuit system.

The unit can also be provided with a non-pressurized auxiliary tank 25 and a pump 27 which draws the water out of said tank and causes it to flow into the boiler. With such an auxiliary tank it is possible to refill the water in the unit even while it is being used.

It is possible to attach different devices to the quick-action coupling at the bottom of the housing, such as, for example, a brush either with or without bristles, a rag-holding accessory, a steam discharge nozzle, or an additional tube ending in a nozzle or a brush.

The novel steam-generating unit, as described above, is much more manageable and handier than the regular steam cleaners.

As a matter of fact, this novel steam-generating unit can be easily stored in limited spaces such as, for example, behind a door, while its weight is distributed along its length which renders it much handier and coupled to a brush, even without using steam, constitutes a large brush.

By attaching one or more straps to the steam-generating unit, together with a flexible hose and a nozzle, the unit can be used by carrying it on one's back to work on vertical surfaces or objects, no matter how high they are.

Figure 1:
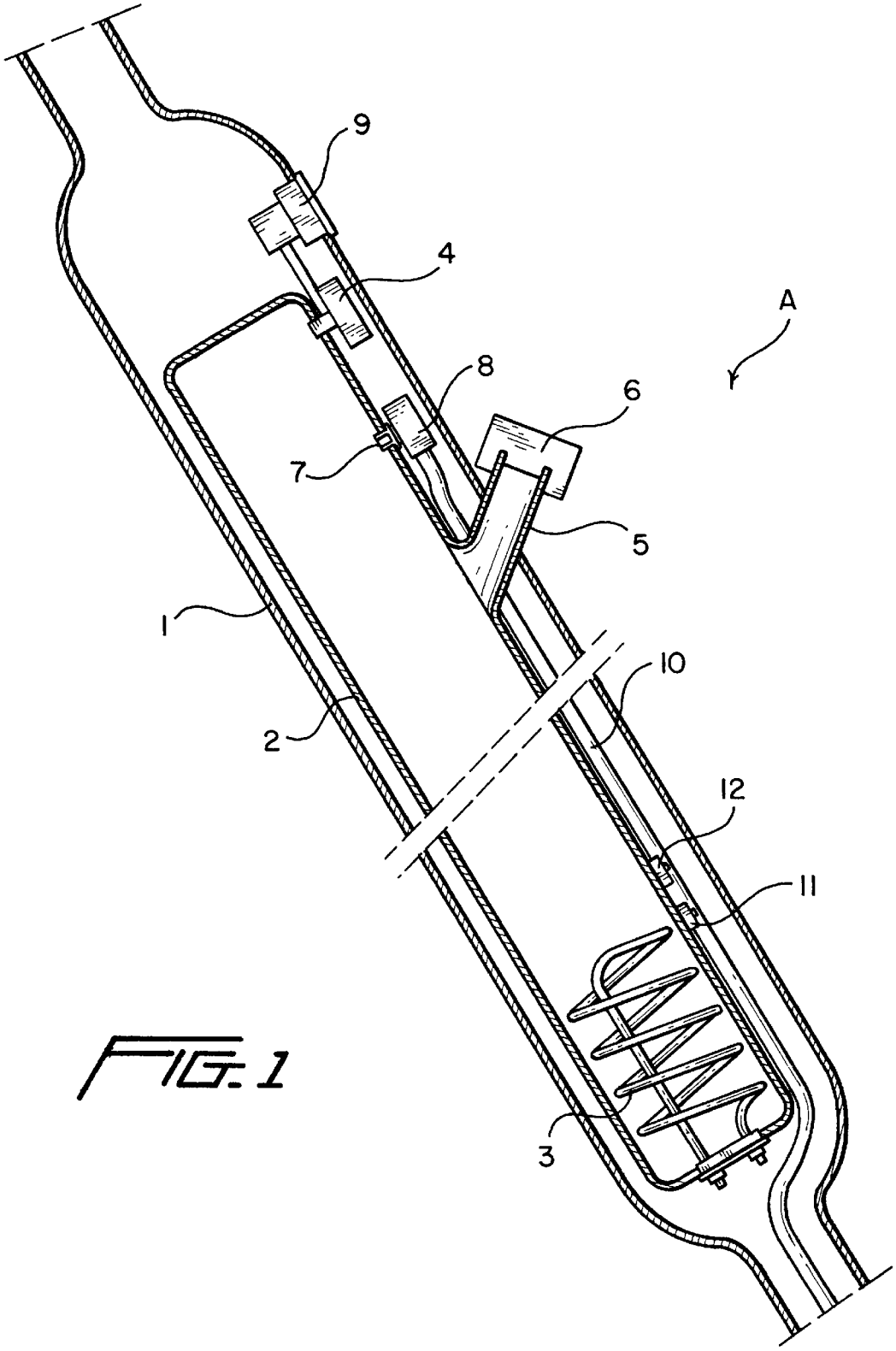
FIG. 1 is a partial cross-sectional view of the steam cleaner of the invention having portions broken away and showing a fluid tank and heater.

FIG. 1 shows a vertical section of the novel steam-generating unit (A). In this illustration can be easily seen the housing (1) inside of which is the boiler-tank (2) in whose bottom portion is installed a thermoelectric resistance (3). On the upper portion of the tank-boiler (2), in addition to the filling tube (5) with a plug (6), is provided the manometer (9) and the pressurestat (4), the opening (7) with the electrovalve (8) for the controlled release of the steam through a tube (10) provided at the bottom part of the housing (1).

In the bottom portion of the tank-boiler (2) are provided two thermostats, of operation (11) and of safety (12).

Figure 2:
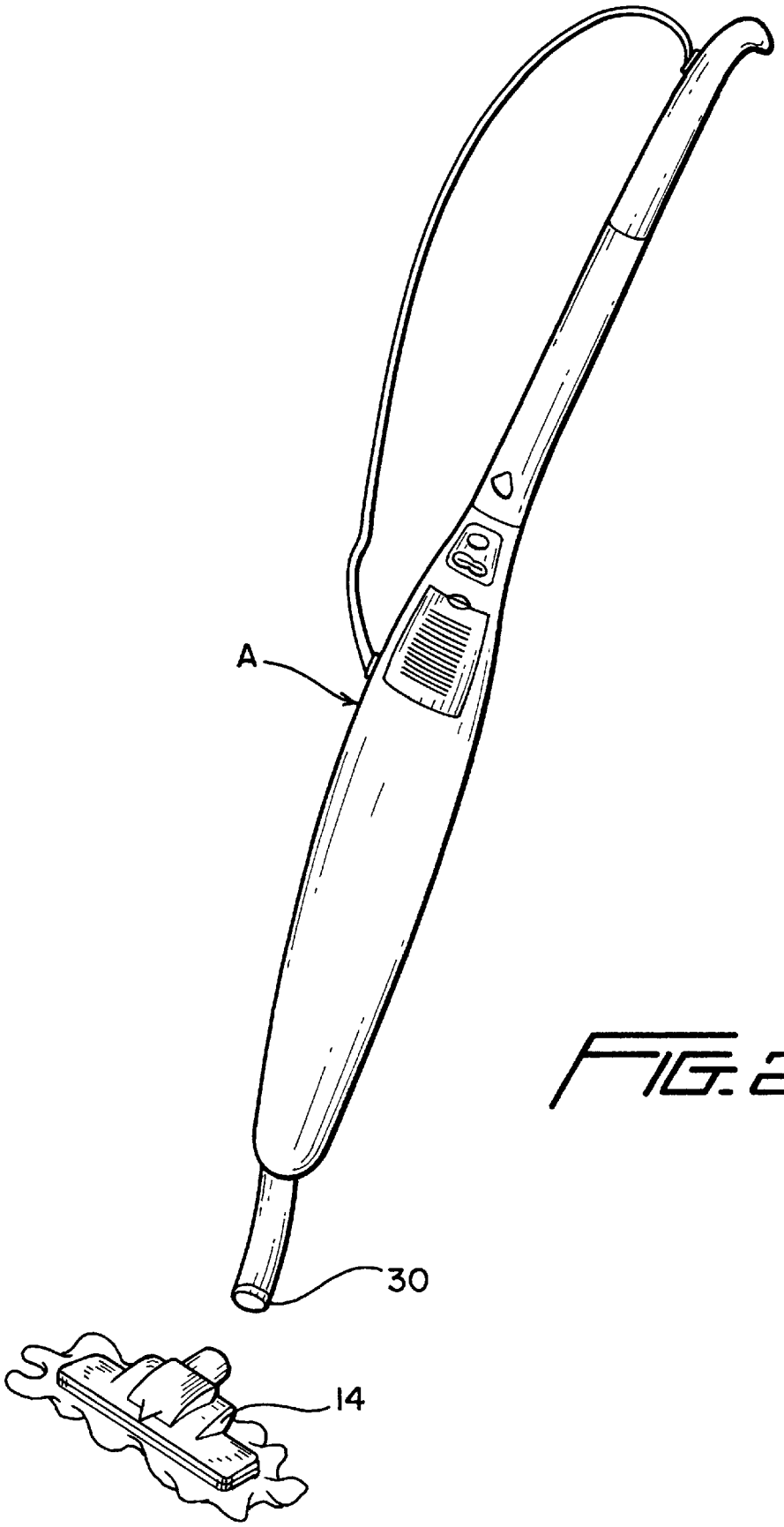
FIG. 2 is a front perspective view of the steam cleaner of FIG. 1.

FIG. 2 shows a type of embodiment of the novel steam-generating unit (A) in conjunction with a brush (14).

FIG. 3*a* shows a vertical section and FIG. 3*b* a horizontal section of the handle with the safety device, which is constituted by a ball (16) inserted in a guide cylinder (17) that actuates upon a lever (18) and on a microswitch (19) for the power supply to the resistance heater in the boiler. Also shown is the trigger lever (20) provided with a pull-back spring (21) that actuates upon the microswitch (22) for the opening of the steam electrovalve, the main switch (23) and the safety warning light (24).

FIG. 4 shows the unit provided with a non-pressurized auxiliary tank (25) with a simple plug (26) and a pump (27) that draws the water out of the tank (25) and causes it to flow into the boiler (2) provided with an outlet opening (28).

The Specification and Drawings are sufficient for the experts to carry out the invention; accordingly, in a concrete application they may contain variants without prejudice regarding the substance of the innovative concept.

Therefore, making reference to the above description and the accompanying illustrations, I file the following claims.

What I claim is:

1. A portable steam generating cleaner comprising, a generally linear and tubular shaped housing having upper and lower ends, said upper end forming a handle, a boiler mounted within said housing, an electric resistance heater mounted within said boiler, means for supplying electrical power to the resistance heater, a steam discharge tube extending from said boiler to said lower end of said housing, an electronically controlled valve for controlling a release of steam from said boiler to said steam discharge tube, a first thermostat means connected to said resistance heater for controlling the operation of the resistance heater and second thermostat means for terminating power to the resistance heater in the event of overheating of the boiler, means connected with said boiler for monitoring pressure therein and means for terminating power to the resistance heater in the event the housing is tilted to a predetermined angle such that the resistance heater is deactivated if water flows away from the resistance heater when the housing is tilted to the predetermined angle.

2. The portable steam generating cleaner of claim 1 in which said lower end of said housing includes a coupling element for attaching cleaning accessories.

3. The portable steam generating cleaner of claim 1 including a strap secured to said housing whereby said housing may be carried by said strap.

4. The portable steam generating unit of claim 1 in which said handle is provided with a trigger lever, means for controlling the electronically controlled valve including a microswitch, said trigger lever being normal urged from said microswitch by a spring element and said trigger lever being engageable to activate said microswitch to provide power for opening said electronically controlled valve to allow steam to exit said boiler.

5. The portable steam generating cleaner of claim 1 further including an auxiliary water tank mounted within said housing, and pump means for conveying water from said auxiliary tank to said boiler.

6. The portable steam generating cleaner of claim 1 further including indicator means operatively connected to said means for monitoring the pressure within said boiler to thereby give a signal when water level within the boiler is below a predetermined level.

7. The portable steam generating unit of claim 1 including a pressure gauge mounted through said housing and operatively connected to said means for monitoring pressure within said boiler.

8. A portable steam generating cleaner comprising, a generally linear and tubular shaped housing having upper and lower ends, said upper end forming a handle, a boiler mounted within said housing, an electric resistance heater mounted within said boiler, means for supplying electrical power to the resistance heater, a steam discharge tube extending from said boiler to said lower end of said housing, an electronically controlled valve for controlling a release of steam from said boiler to said steam discharge tube, a first thermostat means connected to said resistance heater for controlling the operation of the resistance heater and second thermostat means for terminating power to the resistance heater in the event of overheating of the boiler, means connected with said boiler for monitoring pressure therein, means for terminating power to the resistance heater in the event the housing is tilted to a predetermined angle such that the resistance heater is deactivated if water flows away from the resistance heater when the housing is tilted to the predetermined angle, said means for terminating power to said resistance heater when said housing is at a predetermined angle including a guide cylinder, a ball moveable within said guide cylinder, said means for supplying electrical power including a microswitch, said ball being engageable with said microswitch when said housing is in a first operative position and being moveable within said guide cylinder away from said microswitch to open said microswitch to prevent power from being supplied to said resistance heater when said housing is tilted to said predetermined angle.

9. A portable steam generating cleaner comprising, a housing having upper and lower ends, said upper end forming a handle, a boiler mounted within said housing, an electric resistance heater mounted within said boiler, means for supplying electrical power to the resistance heater, a steam discharge tube extending from said boiler to said lower end of said housing, an electronically controlled valve for controlling a release of steam from said boiler to said steam discharge tube, thermostat means connected to said resistance heater for controlling the operation of the resistance heater, and means for terminating power to the resistance heater in the event the housing is tilted to a predetermined angle such that the resistance heater is deactivated if water flows away from the resistance heater when the housing is tilted to the predetermined angle.

* * * * *